US005802667A

United States Patent [19]

Williams

[11] Patent Number: 5,802,667

[45] Date of Patent: Sep. 8, 1998

[54] DUCT CLEANING DEVICE

[75] Inventor: Mark A. Williams, Martinez, Ga.

[73] Assignee: Paula Steates, Martinez, Ga.; a part interest

[21] Appl. No.: 711,220

[22] Filed: Sep. 9, 1996

[51] Int. Cl.[6] ..... A47L 5/38

[52] U.S. Cl. ..... 15/395; 15/397; 15/398; 134/21; 134/22.11

[58] Field of Search ..... 15/398, 395, 397, 15/104.05, 104.066, 104.2; 134/21, 22.11

[56] References Cited

U.S. PATENT DOCUMENTS

| | | | |
|---|---|---|---|
| 1,831,099 | 11/1931 | Densmore . | |
| 1,869,730 | 8/1932 | Antle | 15/395 X |
| 1,902,534 | 3/1933 | Wielatz . | |
| 2,232,358 | 2/1941 | Baerer | 15/104.2 X |
| 2,243,120 | 5/1941 | Pollitt . | |
| 2,606,338 | 8/1952 | De Lorenzo | 15/395 |
| 2,866,221 | 12/1958 | Warva | 15/397 |
| 2,982,971 | 5/1961 | Garaway | 15/1.7 X |
| 3,176,772 | 4/1965 | MacGregor | 15/104.2 X |
| 3,432,383 | 3/1969 | Russell | 134/22.11 X |
| 4,792,363 | 12/1988 | Franklin et al. | 15/395 X |
| 5,109,567 | 5/1992 | Harrison . | |
| 5,383,243 | 1/1995 | Thacker et al. | 15/104.05 X |
| 5,608,941 | 3/1997 | Kleinfeld | 15/395 X |

*Primary Examiner*—Chris K. Moore
*Attorney, Agent, or Firm*—Maria Reichmanis

[57] ABSTRACT

A duct cleaning device, including a flexible conduit with a first, inlet end and a second, outlet end. An end cap with a central hole is attached to the first end; a connector adapted for coupling the device to a vacuum hose (or the inlet of a vacuum cleaner) is attached to the second end. A flexible, radially-projecting brush is attached to the exterior of the conduit, extending helically about the conduit; a plurality of throughholes (some of which carry flexible, radially-projecting tubes) are positioned near the brush. In operation, the device is connected to a source of vacuum. The first end is rotated while being moved into (or removed from) a duct, while the brush sweeps the interior surface of the duct to dislodge particulates of house dust and other contaminants from the surface. The particulates are swept into the conduit through the hole in the end cap and the throughholes in the conduit. The conduit and the brush are flexible, so the device can readily traverse offsets and bends in duct systems without damaging flexible plastic or fiberglass ducts.

20 Claims, 2 Drawing Sheets

DUCT CLEANING DEVICE

BACKGROUND OF THE INVENTION

1. Field of the Invention:

The present invention relates generally to a device for cleaning ducts. In particular, the present invention relates to a device for removing particulates from ducts, flues, vents, and piping in residential and commercial buildings.

2. Discussion of Background:

House dust—composed of dirt particles, pollen, hair, skin flakes, textile fibers, animal dander, residues of construction materials and cleaning products, dust mites, bacteria, fungi, viruses, organic materials in various states of decay, and other contaminants—is found in all residential, commercial, and farm buildings. For most people, the ubiquitous presence of house dust is an annoyance, minimized by more or less regular cleaning. For those who suffer from allergies, asthma, emphysema, or other respiratory disorders, on the other hand, house dust represents a potentially-serious health hazard. Buildings constructed to strict energy-conservation standards are frequently poorly ventilated, resulting in increased exposure to house dust, which in turn may trigger the onset of allergies and respiratory disorders in some people and worsen pre-existing conditions in others. Outbreaks of infectious diseases have been linked to bacteria found in improperly maintained heating, cooling, or ventilation systems (for example, Legionnaire's disease is caused by several species of bacteria which are inhaled via contaminated water droplets produced by cooling systems). These problems are exacerbated as people spend more and more of their time indoors.

Routine cleaning procedures such as dusting, vacuuming, and washing remove some house dust from the interiors of buildings; however, much remains even after extensive cleaning. Some experts have suggested that dusting and vacuuming merely rearrange house dust rather than remove it from the environment. Furthermore, routine cleaning does not disturb the surprisingly large quantities of house dust that accumulate in the ducts of heating, cooling, and ventilating systems of buildings (as used herein, the term "duct" refers to the piping used for heating, cooling, and ventilation systems of buildings, variously known as ducts, vents, pipes, and flues). Air filters remove some house dust from air circulated through these systems; however, most of the dust remains and continues to circulate in the household or work place.

To address these concerns, more and more homeowners and business owners have the duct systems of their buildings cleaned on a regular basis. A variety of duct-cleaning devices are available. Harrison (U.S. Pat. No. 5,109,567) discloses a device that includes a main hose, one end of which supports a hub with an inlet opening and outwardly-extending rotatable tubes. The other end of the main hose is coupled to a vacuum blower. A second, smaller-diameter hose is positioned inside the main hose, with one end connected to the hub and the other end to a compressor. In operation, the compressor injects air through the second hose and the rotatable tubes, thereby rotating the hub and the tubes and injecting air outward onto the walls of the duct being cleaned. The vacuum blower creates reduced air pressure in the main hose to withdraw the loosened material by way of the inlet openings positioned near the end.

Franklin, Jr., et al. (U.S. Pat. No. 4,792,363) describe a vent cleaning system having a flexible tube with a collar and a rotatable shaft at one end, a soft bristled brush coupled to the shaft, a motor for rotating the shaft, and a vacuum for collecting dust dislodged by the brush. The collar has a plurality of side openings. Antle's tube cleaning apparatus consists of a length of rigid tubing with a closed end, a plurality of side openings, and brushes mounted near the end (U.S. Pat. No. 1,869,730). In U.S. Pat. No. 1,831,099, Densmore shows an apparatus for cleaning the hot-air pipes of furnaces, consisting of two arcuate segments, each segment carrying a brush and having an opening at the end. The apparatus is mounted on one end of a vacuum cleaner hose, and is expansible and contractible so that it can be used in pipes of different diameters.

Vacuum cleaner attachments for cleaning between radiator tubes, bed springs, and other difficult-to-access places are also known. De Lorenzo (U.S. Pat. No. 2,606,338) shows a brush attachment having a tubular "handle" with a plurality of side openings and a pair of sleeves for holding removable brushes. Pollitt's attachment consists of a tapered tube that can be fitted to the vacuum cleaner hose, with an end opening, side openings, and removable brush elements (U.S. Pat. No. 2,243,120). Wielatz (U.S. Pat. No. 1,902,534) shows a tube with a closed end, two internal passages, side openings, and longitudinal brushes.

Other cleaning tools that utilize fluid flow are known. For example, Garaway, (U.S. Pat. No. 2,982,971) discloses an apparatus for cleaning swimming pools, consisting of a flexible hose that carries a helical brush or scraper. The hose is connected to an outlet nozzle that oscillates when water flows therethrough, producing jet-cleaning and brushing action on the walls and floor of the pool.

Many known devices are complex and difficult to manufacture; others are difficult to use, or not well suited for cleaning the interiors of lengthy ducts. There is a need for a duct cleaning device that is simple and inexpensive to manufacture, easy to use, and adaptable for use in ducts of varying construction and size.

SUMMARY OF THE INVENTION

According to its major aspects and broadly stated, the present invention is a duct cleaning device, including a flexible conduit with a first, inlet end and a second, outlet end. An end cap with a central hole is attached to the first end; a connector adapted for coupling the device to a vacuum hose (or the inlet of a vacuum source) is attached to the second end. A flexible, radially-projecting brush is attached to the exterior of the conduit, extending helically about the conduit; a plurality of throughholes are positioned near the brush.

In operation, the device is connected to a source of vacuum. The first end is inserted into a duct and rotated while being moved forwards for a desired distance, then withdrawn from the duct as the brush sweeps the interior surface to dislodge particulates of house dust from the surface. The particulates—loose particulates as well as particulates dislodged by the brush—are swept into the conduit through the hole in the end cap and the throughholes in the conduit. The conduit and the brush are flexible, thus, the device can readily traverse offsets and bends in duct systems without damaging flexible plastic or fiberglass ducts.

An important feature of the present invention is the helical brush attached to the exterior of the conduit. The brush, which includes a plurality of flexible bristles, has a diameter somewhat greater than the diameter of the duct to be cleaned therewith. The brush serves several purposes. It sweeps the interior surface of the duct to dislodge particulates of house dust (dirt, pollen, organic matter, etc.) from the surface. The helical configuration of the brush also provides a screw-like action that eases movement of the device through the duct in both the forwards and backwards directions. Furthermore, when the device is inside a duct, the brush substantially occludes the duct, thereby increasing the effectiveness of the vacuum source for drawing particulates into the conduit.

Another feature of the present invention is the throughholes in the conduit. As air is pulled into the device through the hole in the end cap, the air passes over the throughholes and creates additional vacuuming and siphoning action at these openings. At least some small-to-medium size particulates (including suspended particulates) dislodged by the brush are swept into these openings. In one preferred embodiment of the invention, some of the throughholes carry flexible, radially-extending tubes for collecting medium-to-heavy particulates that tend to settle at the bottom of the duct.

Still another feature of the present invention is the end cap, which is preferably rounded so that the device travels smoothly through offsets or bends without "grabbing" the side of the duct. To increase the velocity of air flow into the conduit and the suction created therein by operation of the vacuum source, the hole in the end cap preferably has a smaller diameter than the diameters of either the cap or the conduit.

Yet another feature of the present invention is its flexible design. The dimensions of the components of the device (conduit, end cap, brush, throughholes, flexible tubes) can be adapted for use in different sizes and shapes of ducts. Ducts are generally made in a few standard diameters; the dimensions of the device can readily be optimized for use in ducts of these standard diameters. The brush itself is flexible, thus, the device can be used in ducts having square or rectangular cross-sections as well as ducts having round cross-sections. The device can be attached to a vacuum cleaner hose or (with a sufficiently long conduit) directly to the inlet of a vacuum source.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
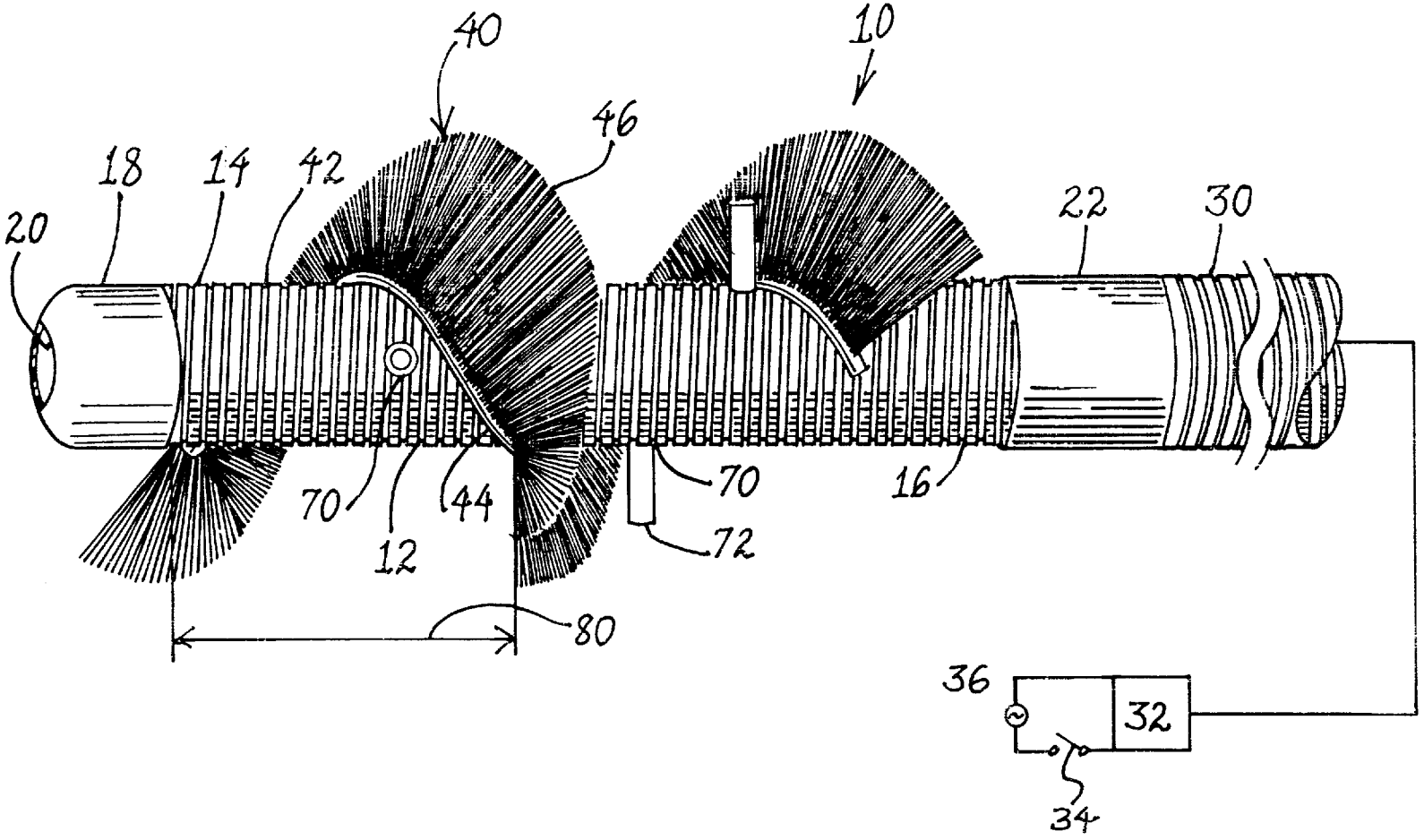
FIG. 1 is a side view of a duct cleaning device according to a preferred embodiment of the present invention.

In the following description, reference numerals are used to identify structural elements, portions of elements, surfaces and areas in the drawings. For consistency, like reference numerals identify the same structural elements, portions or surfaces consistently throughout the several drawing figures, as such elements, portions or surfaces may be further described or explained by the entire written specification. As used in the following description, the terms "horizontal," "vertical," "left," "right," "up," "down," as well as adjectival and adverbial derivatives thereof, refer to the relative orientation of the illustrated structure as the particular drawing figure faces the reader.

Figure 2:
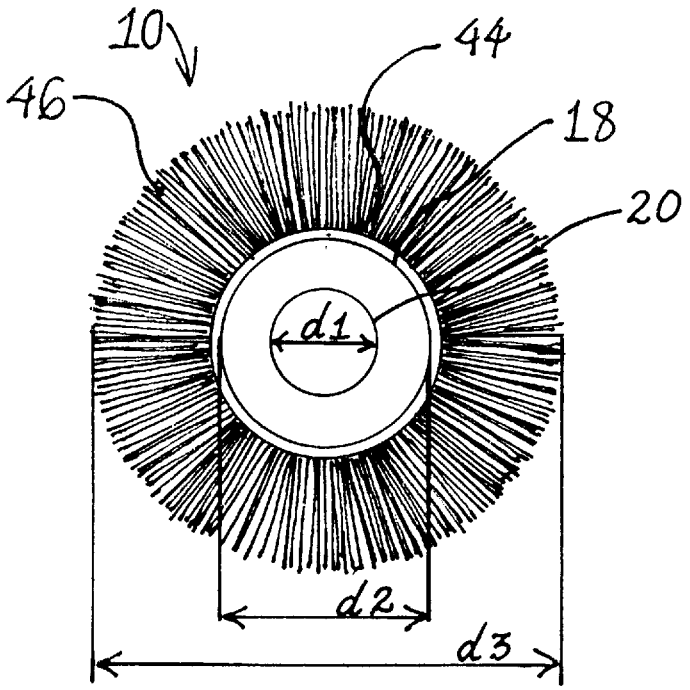
FIG. 2 is a front view of the device of FIG. 1.

Referring now to FIGS. 1 and 2, there is shown a duct cleaning device 10 according to a preferred embodiment of the present invention. Device 10 includes a flexible conduit 12 having a first, inlet end 14 and a second, outlet end 16. A cap 18 with a throughhole 20 is attached to first end 14; a connector 22, adapted for coupling device 10 to a vacuum hose 30, is attached to second end 16. Vacuum hose 30 is connected to a vacuum blower 32 with an on/off switch 34. In operation, vacuum blower 32 is connected to any suitable power source, for example, an AC (alternating current) source 36.

Conduit 12 is made of any tough, durable material that is sufficiently flexible to allow device 10 to easily navigate offsets, bends, and corners in ducts. Suitable materials for conduit 12 include the type of flexible, corrugated plastic material used for heavy duty vacuum cleaner hoses. Cap 18 and connector 22 are made of plastic or other suitable material.

Cap 18 is preferably rounded to enable device 10 to travel smoothly through offsets or bends in a duct, that is, the cap does not "grab" the side of the duct. Hole 20 preferably has a diameter $d_1$ that is smaller than a diameter $d_2$ of cap 18 (FIG. 2), which allows for processing of large amounts of air through the hole. As will be evident, the smaller the diameter of hole 20, the greater the velocity of air flow through the hole and the greater the suction created by operation of vacuum blower 32.

A radially-projecting sweeper element 40 is attached to an exterior surface 42 of conduit 12 (FIG. 1). Sweeper 40, which includes a base 44 and flexible bristles 46, extends rearwards from cap 18 and is wound about conduit 12 in an approximately helical fashion.

Figure 3:
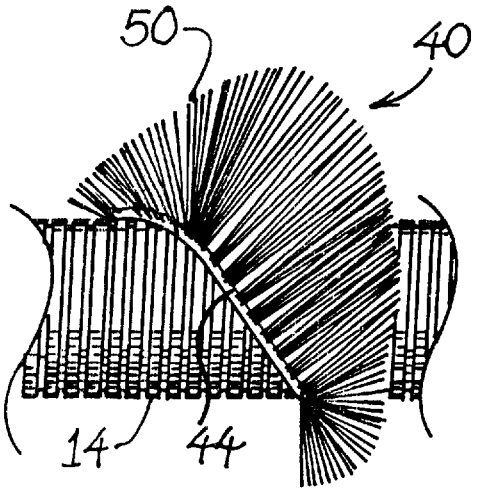
FIG. 3 is a partial side view of a duct cleaning device according to another preferred embodiment of the present invention.

Sweeper 40 may have uniformly-spaced bristles 46 (FIG. 1) or clustered bristles 50 (FIG. 3), made of any suitable materials. Bristles 46, 50 are soft and flexible enough to avoid damaging the ducts wherein device 10 is used, yet sturdy enough to sweep particulates from the interior surfaces of the ducts. Bristles 46, 50 may be made of any suitable natural or synthetic materials, including natural or synthetic fibers, plastic, nylon, or metal. In a preferred embodiment of the present invention, sweeper 40 describes at least approximately 1½ full turns about conduit 12, more preferably at least approximately 2 full turns.

Figure 4:
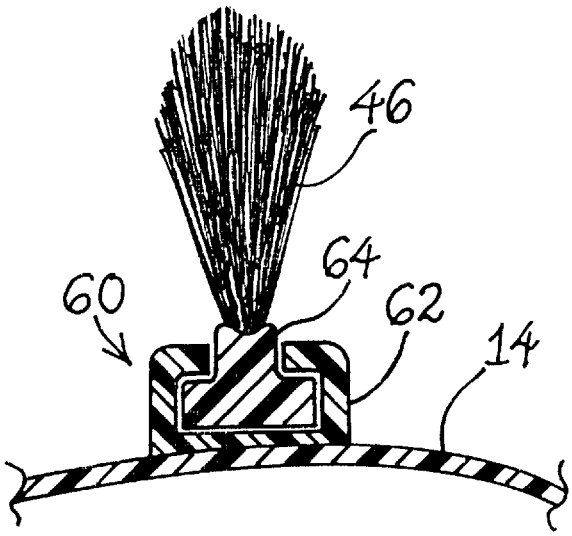
FIG. 4 is a detail, cross-sectional view of a removable brush element according to the invention.

If desired, conduit 14 may carry a modular sweeper assembly 60 (FIG. 4). Assembly 60 includes a base 62 attached to (or integrally formed with) conduit 14, and a sweeper module 64 with bristles 46 or 50. In use, assembly 60 allows the user to select the module 64 deemed most suitable for cleaning a particular duct, then, if needed, replace the module with another to clean a different duct.

Conduit 14 may have a throughhole 70 located near base 44 of sweeper 40 (FIG. 1) or base 62 of assembly 60 (FIG. 4), preferably, a plurality of throughholes 70. Some of holes 70 carry flexible tubes 72 extending radially outwards from conduit 14.

The optimum dimensions of device 10 depend on the dimensions of the ducts, vents, pipes, and so forth to be cleaned with the device. When coupled to a vacuum hose 30, device 10 is approximately 12"–24" (about 30–60 cm) long. However, if conduit 14 is to be coupled directly to vacuum 32, the conduit may be of any suitable length (for example, 20'–30', or about 6–9 m). Conduit 14 is typically approximately 2"–4" (about 5–10 cm) in diameter, with a hole 20 about 1"–3" (about 2.5–7.6 cm) in diameter, holes 70 approximately ½" (about 1.3 cm) in diameter, and tubes 72 that extend to within approximately ½" of the inside of the duct being cleaned. However, dimensions outside these ranges may also be useful for the practice of the invention. The dimensions of conduit 14, hole 20, holes 70 and tubes 72, as well as the numbers of holes 70 and tubes 72, may be varied to produce the performance desired for particular cleaning applications.

Sweeper 40 has a diameter $d_3$ (FIG. 2) at least equal to, and preferably approximately ½" (about 1.3 cm) greater, than the inside diameter of the duct to be cleaned with device 10. This ensures good contact with the inside surface of the duct, even in ducts that are somewhat irregular in shape.

In use, device 10 is connected to vacuum blower 32 and switch 34 is closed. First end 14 is inserted into a duct, device 10 is rotated while being moved forwards into the duct for the requisite distance, then withdrawn. Device 10 need not be rotated continuously while in use. However, the helical configuration of sweeper 40 provides a screw-like action that facilitates axial movement of device 10 through the duct (while this effect is most apparent in ducts having approximately circular cross-sections, the flexibility of sweeper 40 also eases movement through ducts with square or rectangular cross-sections). Rotation of device 10 also enhances the sweeping, particulate-dislodging action of bristles 46 or 50.

As device 10 moves through the duct, sweeper 40 sweeps across the interior surface of the duct, scrubbing the surface and dislodging particulates (dust, debris, pollen, etc.) therefrom. Since sweeper 40 is flexible, it does not damage flexible plastic duct or piping systems. Furthermore, device 10 readily gains access to ducts (including relatively large main ducts as well as smaller subsidiary ducts) through typical vent openings without the need to dismantle the ducts.

Loose particulates are not pushed forwards by device 10, but rather are urged backwards, where at least a portion of the particulates are drawn into the interior of conduit 12 through holes 20, 70 and tubes 72. Some particulates enter hole 20 and are eventually drawn by suction towards vacuum device 32. During movement of device 10, hole 20 may at times rotate towards the bottom of the duct to pick up relatively large and/or heavy particulates.

Vacuum device 32 draws at least some air into holes 70 and tubes 72, creating a siphoning effect which pulls additional particulates into conduit 12. Air drawn through conduit 12 from hole 20 passes over holes 70 and tubes 72, creating additional vacuuming and siphoning action at these openings (since brush 40 substantially occludes the duct, device 32 can draw a good vacuum). Small-to-medium size particulates (including suspended particulates) dislodged by sweeper 40 are entrained in the air stream and swept into holes 70, while medium-to-heavy particulates that tend to settle at the bottom of the duct are picked up by tubes 72. The particulate-containing air stream is pulled towards vacuum device 32, where it is filtered and discharged. Small particulates (including suspended particulates) as well as larger, heavier particulates are thereby effectively removed from the interior of the duct.

As will now be evident, device 10 can be used to effectively clean materials ranging in size from very small, suspended particulates to large, heavy particulates from ducts, piping, etc. The approximately helical configuration of sweeper 40 provides a screw-like action when device 10 is rotated, facilitating easy travel through ducts. Sweeper 40 is tough and durable, but flexible so as not to damage the flexible plastic ducts or piping found in many newer buildings.

It will be apparent to those skilled in the art that many changes and substitutions can be made to the preferred embodiment herein described without departing from the spirit and scope of the present invention as defined by the appended claims.

What is claimed is:

1. A duct cleaning device, comprising:

a flexible conduit having an interior, a first end, a second end, inlet means at said first end, and outlet means at said second end; and a sweeper element carried by said conduit, said sweeper element operable to sweep particulates from an interior surface of a duct when said device is inserted therein, said sweeper element extending helically around a portion of said conduit.

2. The device as recited in claim 1, wherein said sweeper element is near said first end of said conduit.

3. The device as recited in claim 1, wherein said duct has an inner diameter, and wherein said sweeper element has a diameter at least approximately equal to said inner diameter.

4. The device as recited in claim 1, wherein said sweeper element is a brush.

5. The device as recited in claim 1, wherein said inlet means further comprises a cap attached to said first end of said conduit, said cap having a central opening therethrough.

6. The device as recited in claim 1, wherein said inlet means further comprises at least one throughhole in a wall of said conduit.

7. The device as recited in claim 1, wherein said inlet means further comprises at least one tube carried by said conduit, said tube extending radially outwards from said conduit, said tube being in fluid communication with an interior of said conduit.

8. The device as recited in claim 1, wherein said inlet means further comprises at least one tube carried by said conduit, said tube being in fluid communication with an interior of said conduit, and wherein said tube extends radially outwards from said conduit to within approximately ½" of said inner surface.

9. The device as recited in claim 1, further comprising vacuum means for drawing said particulates through said conduit from said inlet means to said outlet means.

10. A device for cleaning a duct, comprising:

a flexible conduit having a first end, a second end, an outer surface, and an interior;

means for coupling said second end of said conduit to a vacuum source;

a rounded cap attached to said first end of said conduit, said cap having a central opening through which particulates can be drawn into said interior by reduced pressure therein when said second end is coupled to said vacuum source; and an outwardly-projecting cleaning element attached to said outer surface near said first end, said cleaning element extending helically around said conduit.

11. The device as recited in claim 10, wherein said duct has an inner diameter, and wherein said cleaning element has a diameter at least approximately equal to said inner diameter.

12. The device as recited in claim 10, wherein said duct has an inner diameter, and wherein said cleaning element has a diameter approximately ½" greater than said inner diameter.

13. The device as recited in claim 10, wherein said cleaning element further comprises a brush.

14. The device as recited in claim 10, wherein said conduit has a diameter, and wherein said opening of said cap has a diameter less than said diameter of said conduit.

15. The device as recited in claim 10, wherein said conduit has at least one hole therethrough, said at least one hole positioned near said cleaning element.

16. The device as recited in claim 10, wherein said device further comprises at least one flexible tube carried by said conduit, said tube positioned near said cleaning element and extending radially outwards from said conduit, said tube being in fluid communication with said interior.

17. The device as recited in claim 10, wherein said duct has an inner surface, and wherein said device further comprises at least one flexible tube in fluid communication with said interior of said conduit, said tube carried by said conduit and extending radially outwards therefrom to within approximately ½" of said inner surface.

18. A method for removing particulates from a duct having an interior surface, said method comprising the steps of:

providing a flexible conduit having a first end with at least one inlet, a second end with an outlet, an outer surface, an interior, and an outwardly-projecting cleaning element attached to said outer surface near said at least one inlet, said cleaning element extending helically around said conduit;

inserting said first end of said conduit into said duct;

coupling said outlet to a vacuum source;

while rotating said conduit, pushing said first end further into said duct so that said cleaning element dislodges particulates carried by said interior surface; and operating said vacuum source to draw at least some of said particulates into said at least one inlet.

19. The method as recited in claim 18, wherein said duct has an inner diameter, wherein said cleaning element has a diameter at least approximately equal to said inner diameter, and wherein said pushing step further comprises manipulating said first end so that said cleaning element substantially occludes said duct.

20. The method as recited in claim 18, wherein said at least one inlet further comprises at least one throughhole formed in a wall of said conduit, and wherein said operating step further comprises drawing at least a portion of said particulates through said hole into said interior.

* * * * *